United States Patent [19]

Levesque

[11] 4,161,087

[45] Jul. 17, 1979

[54] PANELS FOR USE IN CONSTRUCTING BUILDING WALL AND BUILDING WALLS INCLUDING SUCH PANELS

[76] Inventor: Clarence N. Levesque, Westford, Mass. 01886

[21] Appl. No.: 904,936

[22] Filed: May 11, 1978

[51] Int. Cl.[2] ..... E04F 13/12; E04F 19/04; E06B 1/04; E04B 2/02

[52] U.S. Cl. ..... 52/62; 52/410; 52/407; 52/588; 52/210; 52/242; 52/287

[58] Field of Search ..... 52/404, 407, 795, 762, 52/302, 431, 474, 476, 477, 588, 349, 206, 210, 356, 62, 410, 242, 287

[56] References Cited

U.S. PATENT DOCUMENTS

| | | | |
|---|---|---|---|
| 1,748,794 | 2/1930 | Ray | 52/210 |
| 1,821,015 | 9/1931 | Hull | 52/349 |
| 1,988,253 | 1/1935 | Pingenot | 52/204 |
| 2,009,880 | 7/1935 | Eiber | 52/481 |
| 2,097,988 | 11/1937 | Ross et al. | 52/356 |
| 2,101,952 | 12/1937 | Olsen | 52/356 |
| 2,256,394 | 9/1941 | Lamel | 52/210 |
| 2,313,839 | 3/1943 | Olsen | 52/206 |
| 3,736,715 | 6/1973 | Krumwiede | 52/404 |

FOREIGN PATENT DOCUMENTS

| | | | |
|---|---|---|---|
| 91580 | 3/1923 | Austria | 52/62 |
| 614869 | 2/1961 | Canada | 52/588 |

*Primary Examiner*—James L. Ridgill, Jr.

[57] ABSTRACT

A building wall panel includes vertical studs welded to top and bottom channels to provide a rigid framework the maximum width of which is such that the panels may be transported over highways and the length of which is determined by the wanted wall height. Finish sheet material is secured to the inner or rear surfaces of the framework to provide an inner wall. Sections of insulating material are lodged in the rectangular spaces of the framework against a vapor barrier backed by the inner wall and dimensioned to be spaced from the outer surfaces of the framework. A vertically spaced, series of horizontal sub-girts has one secured to each channel and others secured to the studs and the sub-girts secured and the channels may be used to secure flashing. Metal panelling is secured to the sub-girts to provide an outer wall thus providing the panel with a dead air space. The framework is modified to meet door and window requirements. In installation, the end edges of adjacent panels are interconnected, the lower edges of the panels are secured to lengthwise retainers anchored to the floor and upper portions are connected to roof structure.

17 Claims, 19 Drawing Figures

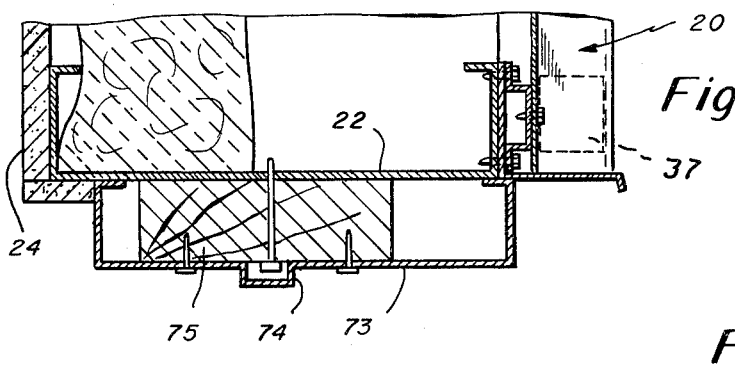
Fig. 11
Fig. 12
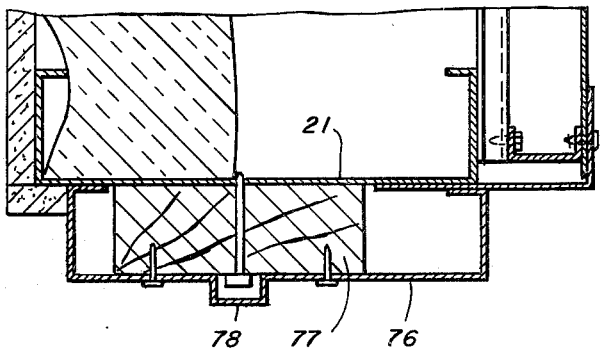
Fig. 13
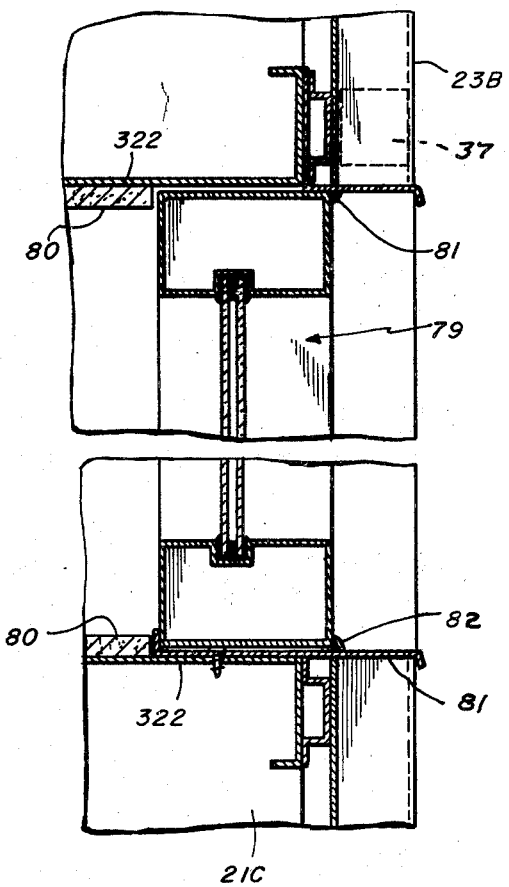
Fig. 14
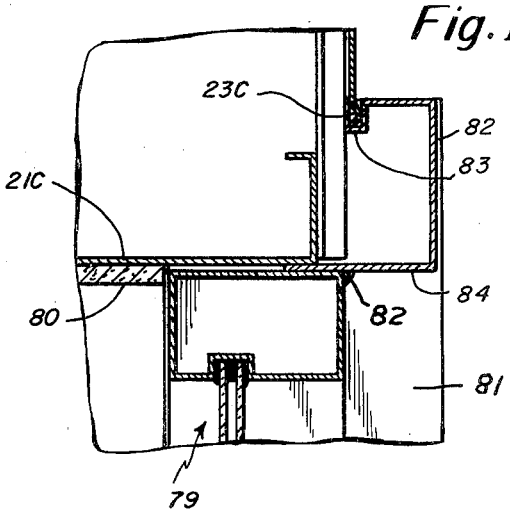

PANELS FOR USE IN CONSTRUCTING BUILDING WALL AND BUILDING WALLS INCLUDING SUCH PANELS

BACKGROUND REFERENCES

U.S. Pat. No. 3,174,590;
U.S. Pat. No. 3,408,782;
U.S. Pat. No. 3,500,596;
U.S. Pat. No. 3,568,388;
U.S. Pat. No. 3,786,607.

BACKGROUND OF THE INVENTION

In the building industry, much attention has been directed to the use of modules, sometimes as framework sections and sometimes as wall sections, as any assembly that can be prefabricated and conveyed to the building site offers both convenience and economy.

In the construction of walls, panels have been proposed but as far as I am aware, none has included inner and outer walls, provided a suitable effective thermal barrier and of a construction that is economically advantageous and at the same time is well adapted to modification to meet the requirements of each building.

THE PRESENT INVENTION

The general objective of the present invention is to provide panels that enable the wall of a building to be erected and to walls containing such panels, the panels providing effectively insulated walls. The panels are of a predetermined maximum width that enables them to be transported over the highway, of the length required by the height of the wanted wall and their construction such that they can be produced on a modular basis capable of being modified as required to provide for any door or window frames.

In accordance with the invention, this general objective is attanied with a rigid framework consisting of a series of metal studs of a length appropriate for the height of the wall to be erected and top and bottom channel members to which the studs are welded and which do not exceed the maximum width wanted for the panels. Finish sheet material is secured to the rear or inner surfaces of the framework to provide an inner panel wall and a section of insulation, dimensioned to be a friction fit in each framework space that is not to be used for a door, window or a portion thereof, is lodged therein against a vapor barrier backed by the inner panel wall. The thickness of the insulation is such that the outer surface of the sections are spaced from the outer surface of the framework.

Vertically spaced sub-girts are secured to the outer surface of the framework, some to the studs and one to each channel and marginally connected sheet metal strips are secured to the sub-girts to provide the outer wall, the outer wall having a series of vertical, hollow ribs the lower ends of which are closed by insulation. The panels include finishing strips secured by or to the sub-girts attached to the channels to provide along the upper strip, a downwardly opening housing receiving the upper edge of the metal panelling and closing the upper ends of the ribs and to provide along the bottom edge or edges of each panel, flashing extending outwardly under the metal panelling and closing the lower ends thereof.

In the case of a wall formed with such panels, the bottom edges of the panels are secured against a lengthwise, floor anchored retainer and the upper portion of each panel includes a connector joined to roof structure which is desirably secured to the panel during its fabrication.

BRIEF DESCRIPTION OF THE DRAWINGS

The accompanying drawings illustrate a preferred embodiment of the invention of which:

FIG. 11 is a section taken along the indicated line 11—11 of FIG. 4;

FIG. 12 is a section taken along the indicated line 12—12 of FIG. 4;

FIG. 13 is a section taken along the indicated line 13—13 of FIG. 4;

FIG. 14 is a section taken along the indicated line 14—14 of FIG. 4;

THE PREFERRED EMBODIMENT OF THE INVENTION

Figure 1:
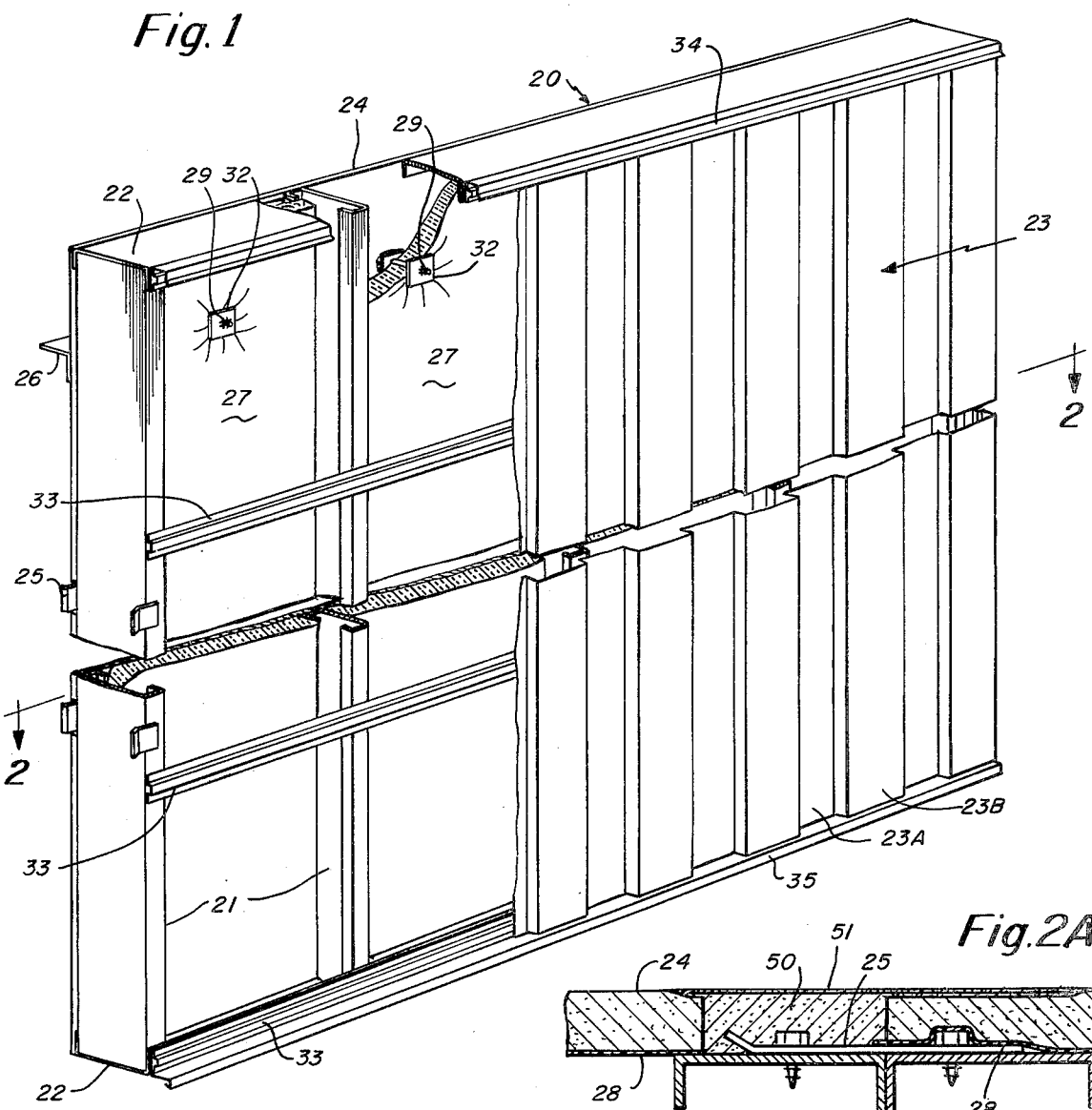
FIG. 1 is a perspective and partly sectioned view of a panel in accordance with the invention with the steel exterior panelling partly broken away.
Figure 2A:
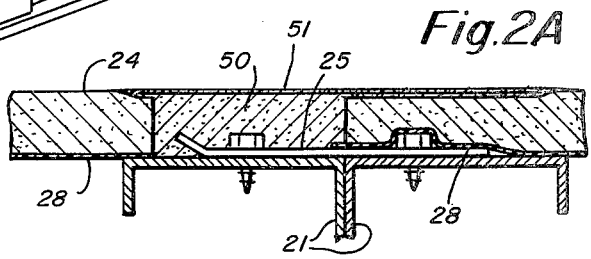
FIG. 2A is a like section but on an increased scale to show the vapor barrier and the completion of the joint between two panels.
Figure 2:
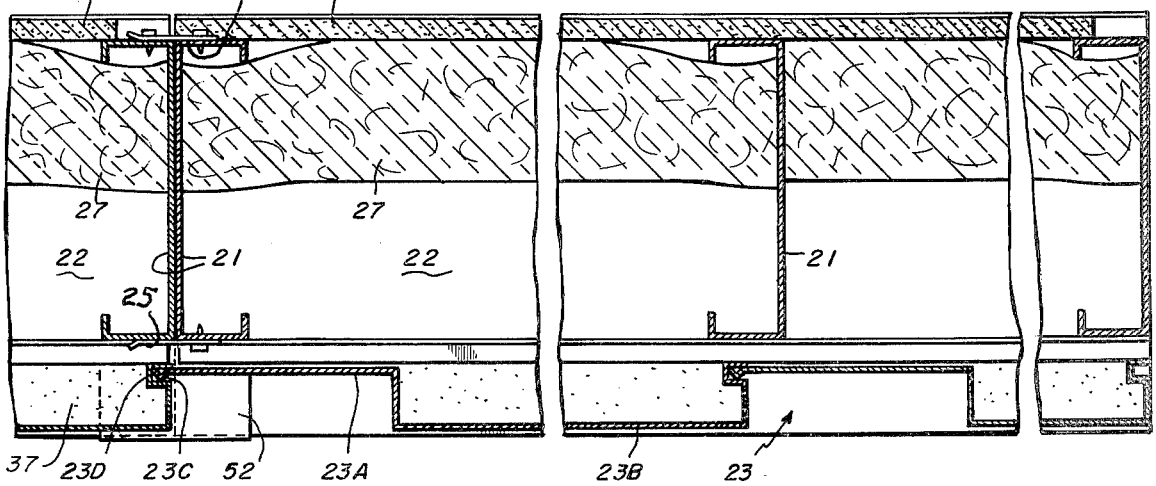
FIG. 2 is a section, on an increase in scale, taken approximately along the indicated line 2—2 of FIG. 1 and showing the connection between two panels.

A panel in accordance with the invention is generally indicated at 20 and, as may best be seen in FIGS. 1 and 2, includes a series of metal studs 21, each shown as a channel the side walls of which are shown as having inturned flanges. The ends of the studs 21 are welded in top and bottom channels 22 thus to provide a rigid framework. In practice, the maximum width of the panels is eight feet with the studs spaced apart sixteen to twenty-four inches on centers depending in part of the width and height of the wall and in part on the structural members used. The panel lengths depend on the wall height and, typically are within the ten to thirty foot range. In some cases, the studs 21 may be interconnected by intermediate lengths of channels.

The panel 20 has outer and inner walls. The outer wall is generally indicated at 23 and the inner wall 24 consists of sections of a material suitable for finishing the interior of the building, gypsum board sections, for a preferred example. The inner wall sections are secured to the inner side walls of the studs 21 and to the corresponding side walls of the channels 22.

Before the inner wall 24 is attached, vertically spaced clips 25, see FIGS. 2 and 2A, are attached to the inner and outer side walls of the studs 21 at one end of each regular or basic panel 20, the left hand end stud in FIG. 2. Each section of the inner wall 24, when attached has one end edge covering the anchored ends of the clips 25 and the inner side wall of the stud to which the clips 25 are attached. The other ennd edge of each section of the wall 24 is spaced from the end face of the other end stud 21 by a distance at least equal to the length of the exposed ends of the clips 25.

Figure 3:
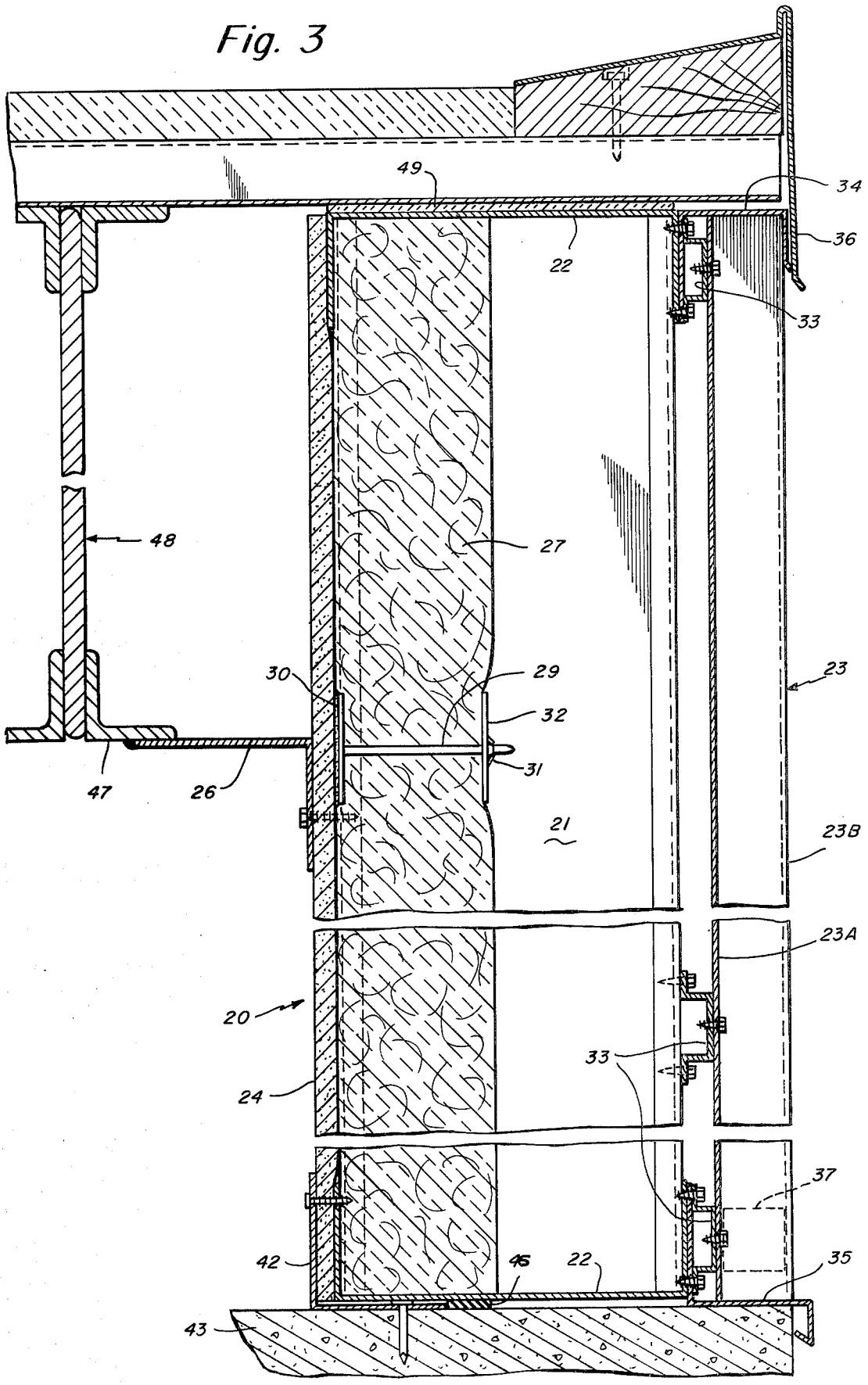
FIG. 3 is a section, on a further increase in scale, taken vertically through a panel installed on a sill.

After the inner wall 24 is completed, a connector 26 is secured thereto in a predetermined relationship to the upper edge of each panel 20, typically below that edge as shown in FIG. 3. The connector 26 is shown as of right angular section with one wall connected to the inner side walls of the studs 21 through the wall 24.

Sections 27 of insulation, in practice, fibreglass, are provided, each section dimensioned to be a friction fit in a rectangular framework space defined by each two adjacent studs and the channels thus to be in sealing engagement therewith. A vapor barrier 28, see FIG. 2A, is between the inner wall 24 and the insulating sections 27 and the barrier 28 may be a coat such as an aluminum foil coat on the sheet material of which the wall 24 is formed but is preferably a separate sheet, of which polyethylene is a preferred example, as a separate sheet may then extend beyond the ends of an inner wall section and overlie the junction of abutting studs 21.

The insulation sections 27 are pressed into the framework against the vapor barrier 28 which if a separable sheet is backed by the inner wall 24. The upper end of each insulating section 27 is anchored to the inner wall 24 and for this purpose spikes 29 are used that are held by sheets 30 adhesively secured to the inner surface of the wall 24 and of a length to extend through an insulating section 27 thus to enable keepers 31 to be pressed and caught thereon to secure a plate 32 against impaled insulating sections 27.

Horizontal sub-girts 33 are attached to the outer side walls of the studs 21 and to each channel 22, and in practice, the sub-girts 33 are spaced four feet apart. As may best be seen in FIG. 3, the uppermost sub-girt 33 is used to anchor the inner wall of a lengthwise metal closure 34 shown as in the form of an inverted U and the lowermost sub-girt 33 anchors a lengthwise flashing 35 to the bottom channel 22.

The outer wall 23 of the panel 20 is sheet steel and in practice consists of commercially available corrugated strips of a length equal to the height of the panel 20. Each strip includes a lengthwise flat section 23A attached to the sub-girts 33 as by screws, and a lengthwise rib 23B, typically rectangular in cross section. The section 23A has a lengthwise, marginal bead 23C and the rib 23B has a lengthwise marginal pocket 23D located and dimensioned to receive the marginal bead 23C of another strip. Each bead 23C is shaped and dimensioned to be a friction fit in the pockets 23D of another strip. Except for the bead 23C, the section 23A is the same width as the rib 23B. As shown in FIG. 2, the bead 23C of the strip at the left hand end of a panel 20 projects in order that it may be entrant of the pocket 23D of the strip at the proximate end of the adjacent panel 20.

It will be noted, see FIG. 3, that the upper ends of the rib 25B are closed by the closure 34 in the bottom edge of the outer wall which frictionally engages the inner surface of the facia 36. The lower ends of the rib 23B are closed by the flashing, the flashing 35 in FIG. 3. A seal 37 in the form of a plug of insulating material is inserted in the lower end of each rib 23B before the strips are attached to the sub-girts 33 and are frictionally held therein.

Figure 4:
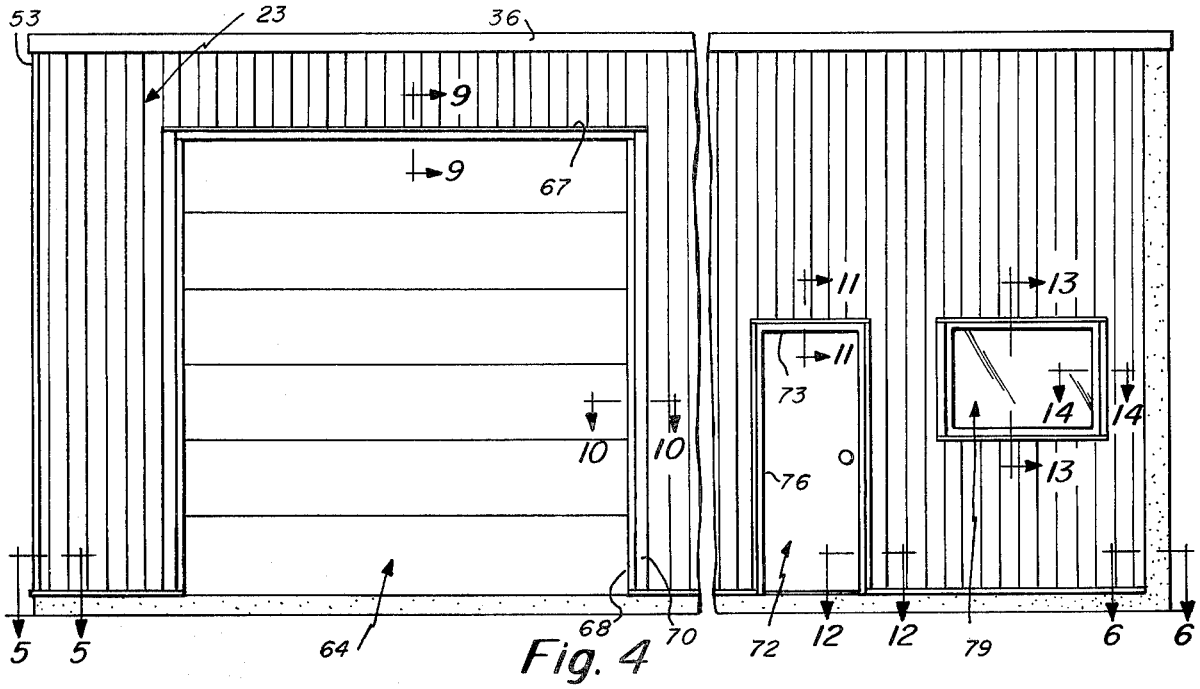
FIG. 4 is a view of a building wall formed by panels in accordance with the invention.

While the basic modular panel 20 is as thus described, the modules may be readily modified as required by specified wall features such as doors and windows and also where a special panel of less width is wanted or where a special panel is needed to complete a wall over a doorway. Such features are illustrated by FIG. 4.

When a panel 20 is to be less than eight feet in width to complete a wall, it is sometimes necessary to space an end stud a distance from the next adjacent stud less than the preferred sixteen to twenty-four inch spacing. Where a door or window is wanted it may be necessary to modify the channel and stud arrangements of a panel to enable a door or window frame to be located as specified within that panel or to provide marginal space for a vertical portion of a door or window frame.

Figure 15:
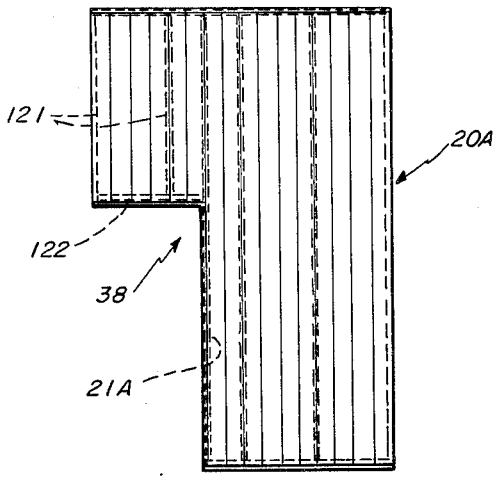
FIG. 15 is a view of a panel modified to incorporate a vertical portion of a door frame.

By way of examples of modified panels, reference is made to FIGS. 15–18. In FIG. 15, the panel 20A is shown as having at least a portion of a doorway frame generally indicated at 38 for a door incorporated in one margin thereof requiring a short end and an adjacent stud 121 connected to a short additional channel 122 welded to the next adjacent full length stud 21A.

Figure 16:
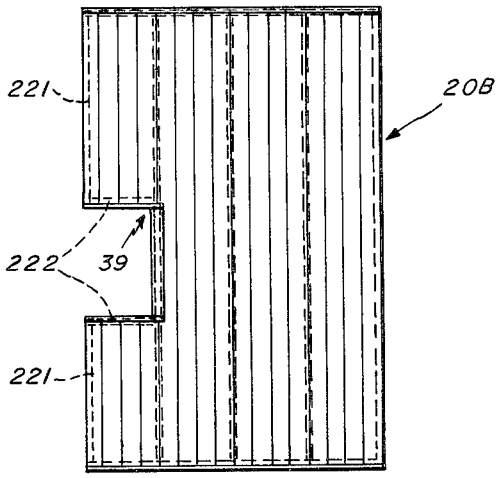
FIG. 16 is a like view of a panel modified to incorporate a vertical portion of a window frame.

The panel 20B as shown in FIG. 16 includes a vertical part of a window frame generally indicated at 39 incorporated in a margin thereof thus requiring vertically spaced end stud sections 221 to each of which and the adjacent full length stud 21B, a channel member 222 is welded.

Figure 17:
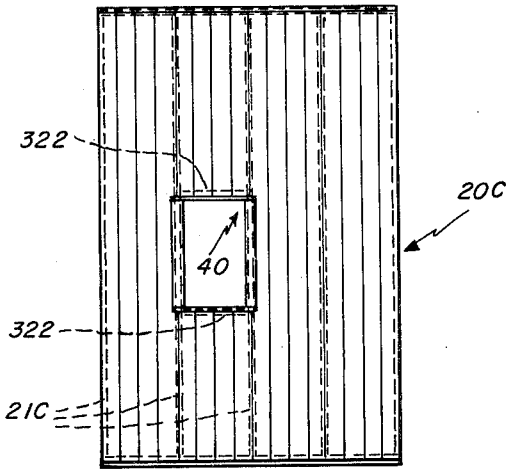
FIG. 17 is yet another view of a panel, the panel modified to incorporate a window frame within it.

The panel 20C shown in FIG. 17 has a window frame, generally indicated at 40, incorporated therein between two studs 21C with a channel member 322 welded to each and to adjacent studs 21C and providing space for the frame 39.

Figure 18:
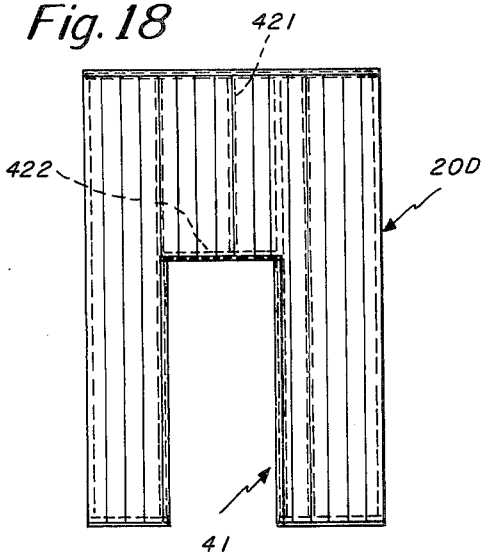
FIG. 18 is another like view of a panel modified to incorporate an entire door frame.

In FIG. 18, the panel 20D has a doorway frame, generally indicated at 41, wholly incorporated therein with at least one intermediate stud 421 welded only to the top channel 21D and sufficiently short to accommodate a channel member 422 welded to adjacent full length studs 21D between which and below the channel member 422 the doorway frame 40 is located. Doorway features are detailed in conection with FIGS. 9–12 and window features are detailed in connection with FIGS. 13 and 14.

The fabricated panels are trucked to the erection site and are installed by means of a crane in a building erected to the point requiring only the completion of one or more walls with panels in accordance with the invention to enable windows and doors to be installed to complete the wall. In accordance with the invention, before the panels are installed, a retainer 42 of right angular section is nailed to the sill 43, see FIG. 3, or anchored to an installed structural channel 44 on a foundation wall 45, see FIG. 8. The retainers 42 are levelled by shims, not shown, and caulking 46 is utilized as a seal outwardly of the retainers 42.

Each connector 26 is secured, desirably by a weld, to a beam, such as the beam 47 of roof supporting structure generally indicated at 48, see FIG. 3. In practice there is a light clearance above each installed panel that is sealed as at 49 by insulating material.

While such an installed panel is thus securely held, abutting panels are held in lengthwise alignment by the clips 25 the ends of which that are exposed at one panel end and spaced vertically along both the inner and outer side walls of the stud 21 at one end of the panel. The clips 25 frictionally engage the side walls of the studs 21 which are exposed at the proximate end of the next panel, see FIGS. 2 and 2A. The clips 25 overlapping the inner exposed stud side wall of the proximate stud 21 are anchored thereto as by screws. The space between adjacent inner walls 24 is then filled as at 50 and covered with tape 51, see FIG. 2A. The abutting ends of the flashing 35 of the outer walls of abutting panels are covered by clips 52.

Figure 5:
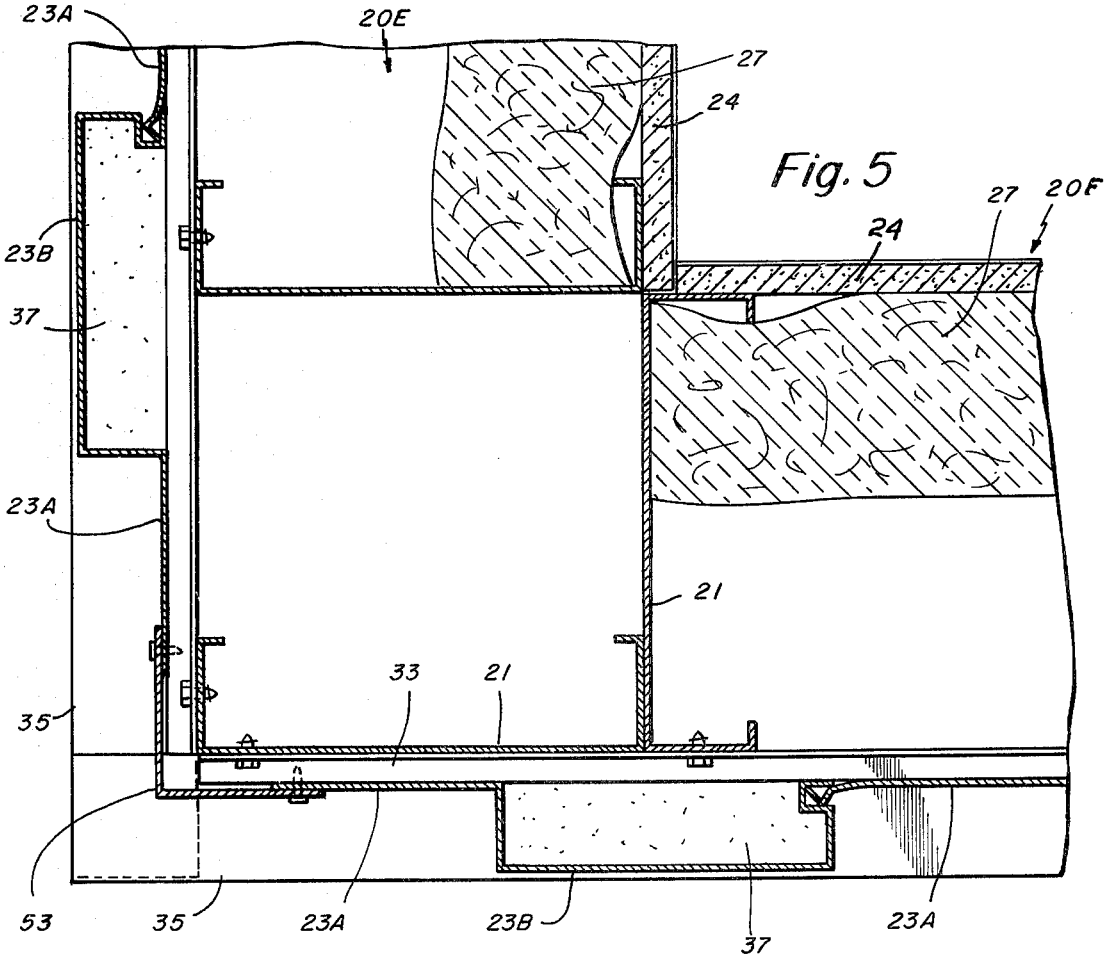
FIG.5 is a section, on an increase in scale taken along the indicated line 5—5 of FIG. 4.

One typical installation, in cases where the corner of a building is to be established by two panels is illustrated by FIG. 5, one panel 20E is modified only by the removal of the bead from the end strip of its outer wall 23 and by having the inner wall 24 terminated to permit the end stud 21 of the other panel 20F to butt against the inner wall of the end stud 21 of the panel 20E. The panel 20F is not regular in that only its sub-girts 33 and outer wall are of full length so that they extend across and cover the end stud 21 of the panel 20E. The inner wall 24 of the panel 20F is dimensioned to butt against the inner wall of the panel 20E. A corner trim 53 is held by screws to the sub-girts 33 of the two panels.

Figure 6:
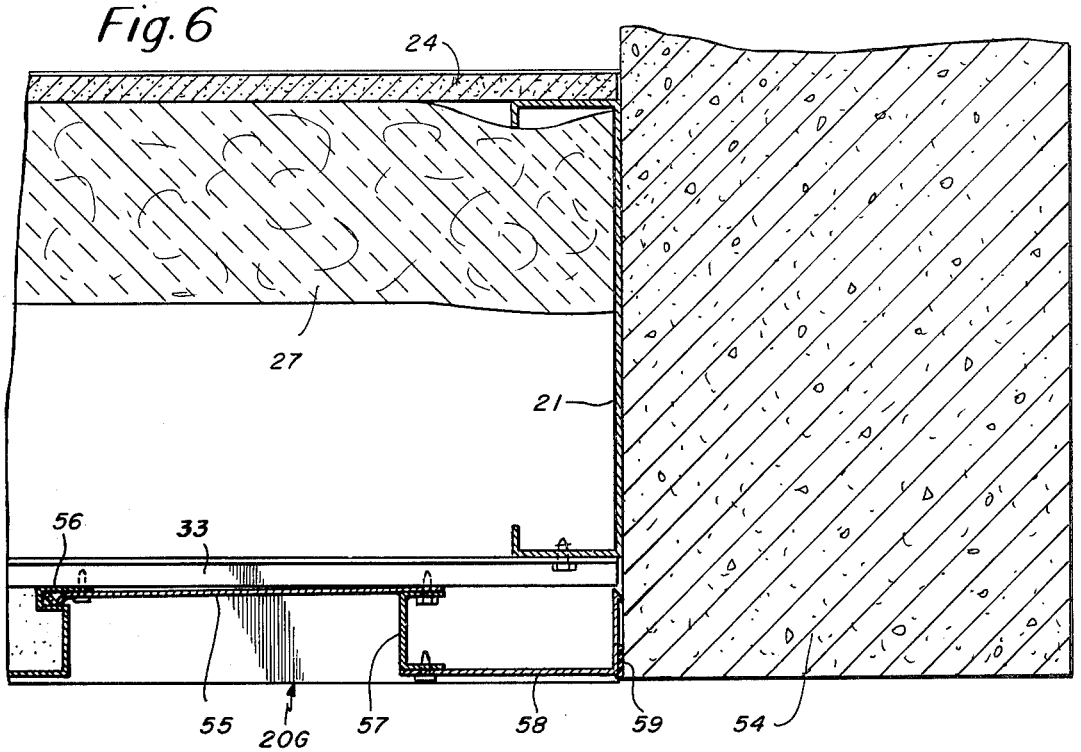
FIG. 6 is a section taken along the indicated line 6—6 of FIG. 4.

As illustrated by FIG. 6, a corner may require that a panel 20G be butted against a masonry wall 54. In this situation the sub-girt 33 and the inner wall 24 are or may be full length with a stud 21 butted against the wall 53. The outer wall 23 is completed by a metal strip 55 provided with a bead 56 and anchored to the sub-girts 33. A hollow trim includes a U-shaped filler flashing 57 the inner wall of which is held by screws to the sub-girts 33 and an end wall flashing 58 of right angular section includes an outer wall attached as by screws to the outer wall of the filler flashing 57 and an end wall with caulking 59 as a seal between it and the masonry wall 54.

Figure 7:
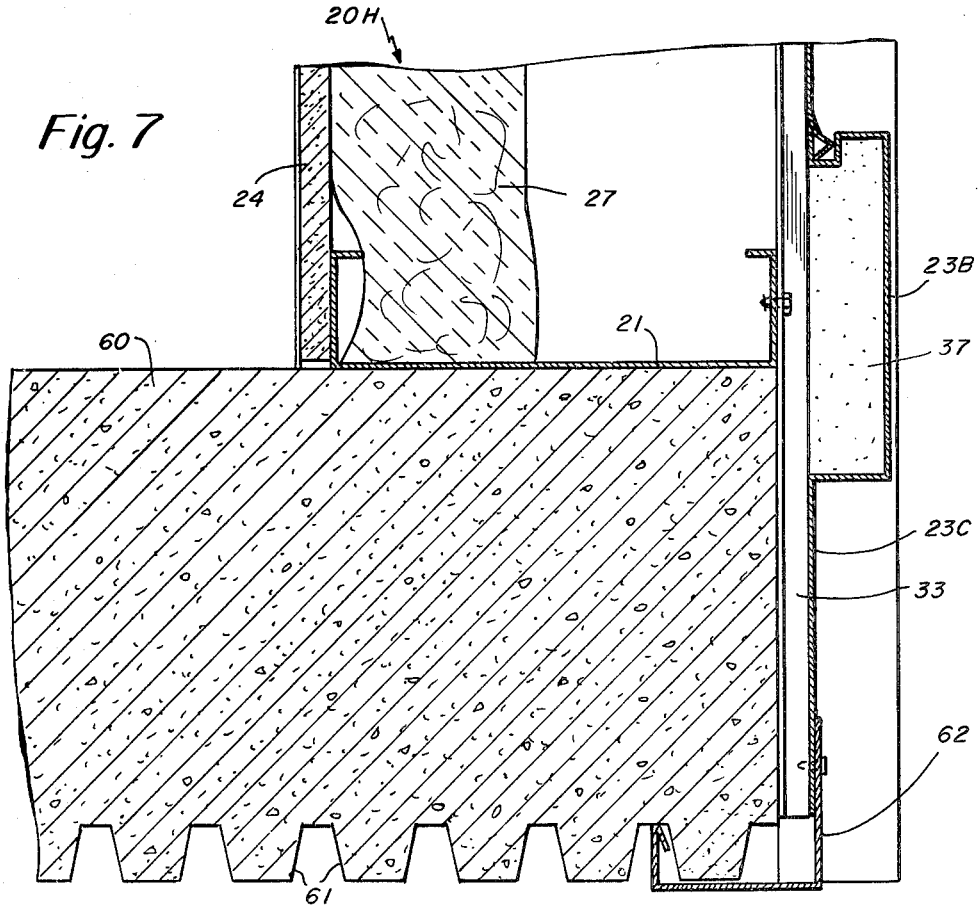
FIG. 7 is a like view of a panel installation with another type of corner construction.

The adaptability of the invention is further illustrated by FIG. 7 in which a masonry wall 60 is formed with vertical ribs 61. In this situation, the construction of the panel 20H may be identical to the panel 20F with its sub-girts 33 and the metal outer wall 23 covering the end of the wall 60. A corner trim 62 of U-shaped section has one wall connected to the sub-girts 33 through the strip 35 and its other wall caught in the channel between two ribs 61 and frictionally engaging a wall thereof.

Figure 8:
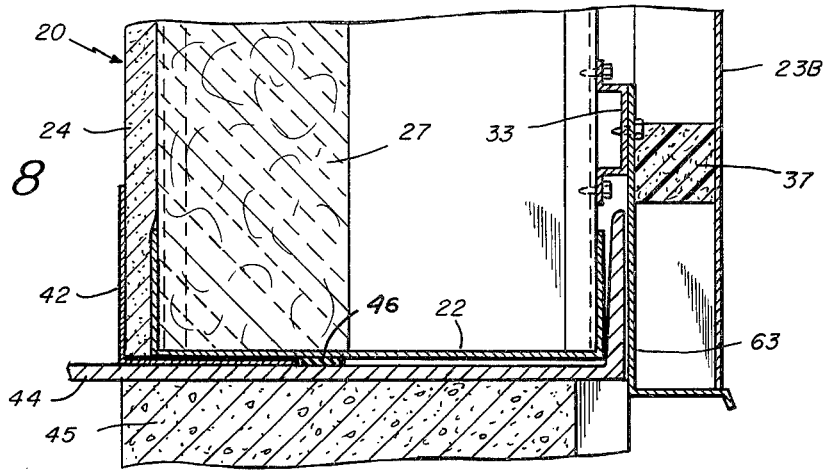
FIG. 8 is a fragmentary vertical section illustrating the installation of a panel on a foundation wall.

In FIG. 8, as previously noted, the foundation wall 45 supports a structural channel 44 provided with a retainer 42 on which the bottom channel 22 of a panel 20 rests. The sub-girts 33 and the outer flange or side wall of the channel 44 are in the same plane and the flashing 63 is locked to the lowermost sub-girt 33 rather than by it.

Figure 9:
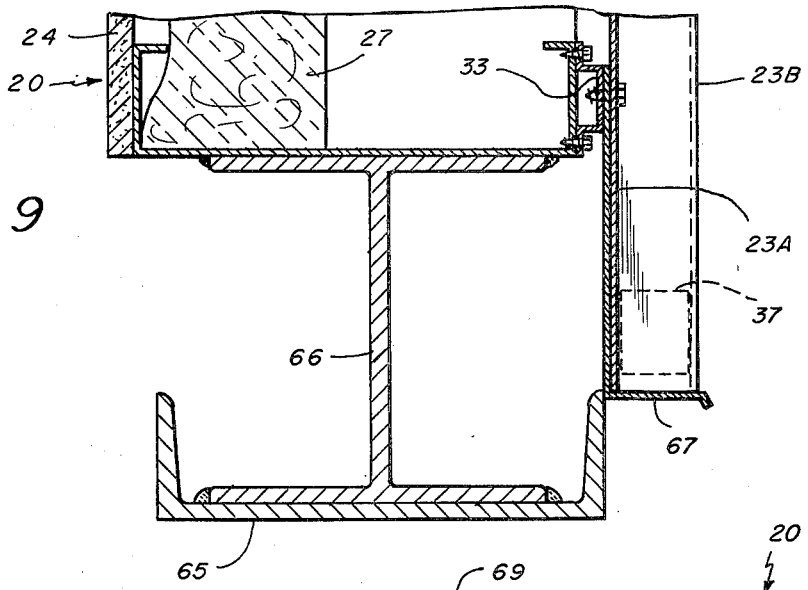
FIG. 9 is a section taken approximately along the indicated line 9—9 of FIG. 4.
Figure 10:
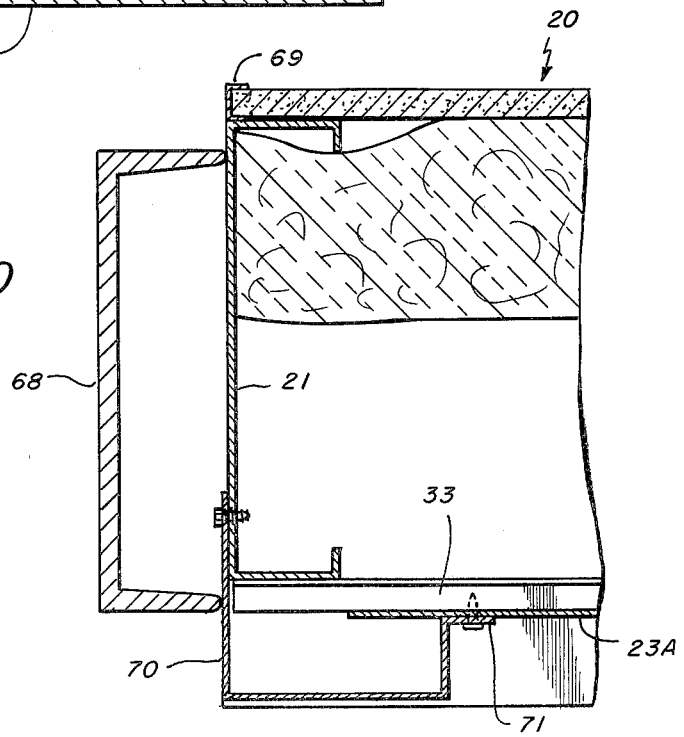
FIG. 10 is a section taken along the indicated line 10—10 of FIG. 4.

Many buildings, see FIG. 4, require an overhead door 64 and the variations in the construction of panels required in that case are illustrated by FIGS. 9 and 10, the head construction being illustrated in FIG. 9 and the panel requirements shown in FIG. 10. See also FIGS. 15 and 18.

In FIG. 9, the head of the doorway frame is shown as a channel 65 welded to an I beam 66 on which a panel is supported. The width of an overhead door 64 may result in the use of panels such as the panels 20A of FIG. 15. The sub-girts 33 and the outer wall of the channel 65 are in the same plane and the strips of the outer wall 23 extend downwardly to close the space between the lowermost sub-girt and the channel 65. The flashing 67 is caught against the lowermost sub-girt 33 and extends outwardly under the bottom edges of the outer wall.

The construction of one of the panels is illustrated by FIG. 10. The jambs are vertical channels 68 so disposed that the sub-girts 33 and the outer sides of the channels 68 are in the same vertical plane so that the inner wall 24 is offset relative to the inner flange or side or a channel 68 to be flush with the installed door 64 when shut. The proximate edge of the inner wall 24 is protected by a U-shaped trim 69. One side wall of a vietical U-shaped trim 70 has an end flange 71 anchored to the sub-girts 33 and the other side wall is secured to the face of the channel 27. The outer wall of the trim 70 is in the plane of the corrugations 23B.

The necessary changes in the construction of panels when a side hinged door 72 is desired are illustrated by FIGS. 11 and 12.

In FIG. 11, the head of the door frame is shown as a rectangular, U-shaped transverse channel 73 having inturned ends and an external transverse, central ridge 74 of rectangular section and a wood filler 75 secured to the channel 22 by screws. In FIG. 12 a vertical jamb establishing channel 76, similar to the channel 73 is secured to a stud 21 with a wood filler 77 within the channel 76 and with its ridge 78 in the plane of the ridge 74.

The installation of windows 79 presents a somewhat different problem. As illustrated by FIGS. 13 and 14, the window is to be incorporated in a panel such as the panel 20B of FIG. 17. The head and sill of the window frame 40 are defined by channel members 322 and the sides thereof by studs 21C. Finish material 80 is secured to each frame member with the outer margins in the same plane. A flashing 81 is anchored to the sill channel with its outer edge extending at least to the plane of the corrugations 23B. The window 79 is seated against the edges of the material 80 and is sealed in place by grouting 82. In the case of the jambs, a trim has a rectangular section provided with a pocket 83 for the bead 23C of an outer wall strip and a wall 84 extending inwardly and connected to the face of a stud 21C.

I claim:

1. A modular panel for use in constructing the wall of a building, said panel including at least two channel members whose lengths do not exceed a predetermined maximum determined by transportation limitations, and a series of stud members welded to said channel members to provide a rigid framework dimensioned to provide a predetermined lengthwise and vertical portion of a wall of a building, finish sheet material secured to the inside of said framework to provide an inner panel wall, sections of insulation for at least some of the rectangular spaces established by said framework, said sections shaped and dimensioned to be a press fit in said spaces and fitted therein and frictionally held by said framework, a vapor barrier backed by said inner wall, said insulation sections lodged against said barrier, a plurality of vertically spaced sub-girts for the outer side of the framework and including one for each channel member and secured thereto and others secured to said stud members, corrugated metal panelling providing a series of spaced, vertical channels and outwardly disposed ribs, the channels secured to said sub-girts to provide an outer panel wall, said insulating sections of a thickness to provide a dead air space between said sections and said outer wall, and flashing anchored to said panel in back of said panelling by sub-girts and extending outwardly under the bottom edges of said panelling.

2. The modular panel of claim 1 in which one member is a bottom member and the other a top member and the bottom member is shorter than the top member and has at least one end spaced inwardly of the corresponding end of the top member by a distance equal to the width of at least a vertical portion of a doorway frame having head structure and jambs, the outer surface of the frame in the plane of said sub-girts, at least at one end of the panel at least one stud is secured to the top member and terminates above the bottom member the distance required by said frame, and the panel includes a third channel member welded to said short stud and to the next adjacent full length stud, said channel member supported by said head structure and said next adjacent stud butted against a jamb.

3. The modular panel of claim 1 in which at least one intermediate stud terminates short of the bottom member, the panel includes a third channel member to which the lower end of said short stud is welded and which is welded to adjacent full length studs the spacing between which is that of a wanted doorway frame, and said bottom member includes two sections spaced apart by said doorway frame width, the distances between said third channel and the bottom of the panel equal to the wanted height of said doorway frame.

4. The modular panel of claim 1 in which at least one intermediate stud includes upper and lower sections the ends of which are vertically spaced by a distance equal to the wanted height of a window frame, and the panel includes third and fourth channel members, each welded to the end of an appropriate one of said stud sections and to adjacent full length studs the distance between which is the wanted width of said window frame.

5. The modular panel of claim 1 in which at least at one side edge of a panel there are upper and lower steel sections spaced apart a distance required for a particular window frame and the panel includes third and fourth channel members, each welded to the end of an appropriate one of said stud sections and to the adjacent full length stud the distance between which is at least a part of the wanted width of said window frame.

6. The modular panel of claim 1 and alignment clips secured to inner and outer side walls of the studs at one side edge of the panel, said clips protruding from said side edge parallel with said inner and outer side walls, one end of said inner wall overlying said inner side wall and the secured ends of the clips, the other end of said inner wall terminating short of the other side edge of the panel to expose the inner side wall of the stud at said other side edge whereby when said panel is installed, another like panel may be slid into endwise engagement therewith with end studs in engagement, the free ends of the inner clips exposed and overlying the inner side wall of the proximate stud of the second named panel, and with the outer clip in frictional engagement with the outer side wall of said proximate stud.

7. The wall panel of claim 1 in which the framework includes channel and stud members defining a space for at least part of a frame including at least one channel member and one stud member, and a trim secured to said one stud member and to the proximate end of the margin of said panelling.

8. The wall panel of claim 1 and a hollow trim secured to the margin of the metal panelling and spaced from the proximate rib, said trim including a detachable section including an outer wall and an end wall disposed at right angles thereto to abut against an existing wall thereby to enable grouting to be inserted against the existing wall when the panel is in place.

9. The modular panel of claim 1 and a housing securec by a sub-girt to the top channel member in which the upper edge of the metal panelling is received with the upper ends of the ribs closed thereby.

10. The modular panel of claim 9 and a blocking section of insulation in the lower end of each rib.

11. The modular panel of claim 1 and means to anchor the upper end of each section of insulation to the inner wall and against the vapor barrier.

12. The modular panel of claim 9 in which the anchoring means includes members affixed to the inner surface of the inner wall on which the insulating sections are impaled, and locking means attached to the exposed ends of said members engage and partly compress the sections of insulation.

13. A building wall including a series of panels, supporting structure on which said panels rest in lengthwise alignment, said structure including a fixed lengthwise support, and roof structure including a lengthwise beam, each panel including at least two channel members whose lengths do not exceed a predetermined maximum determined by transportation limitations, one channel member a top member and the other member a bottom member, and a series of stud members welded to said channel members to provide a rigid framework dimensioned to provide a predetermined lengthwise and vertical portion of said wall, finish sheet material secured to the inside of said framework to provide an inner panel wall, sections of insulation for at least some of the rectangular spaces established by said framework, said sections shaped and dimensioned to be a press fit in said spaces and fitted therein annd frictionally held by said framework, a vapor barier backed by said inner wall, said insulation sections lodged against said barrier and a plurality of vertically spaced sub-girts for the framework and including one for each channel member and secured thereto and others secured to said stud members, and corrugated metal panelling provided with a series of spaced vertical channels and outwardly disposed ribs, said channels secured to said sub-girts to provide an outer panel wall, said insulating sections of a thickness to provide a dead air space between said sections and said outer wall, said panels resting against said support and anchored thereby, said inner wall including a lengthwise connector flange to said beam, and flashing anchored to said panels in back of said panelling and extending outwardly under the bottom edges thereof.

14. The building wall of claim 13 and alignment means carried by the stud at one end of each panel connected to the proximate stud of another panel.

15. The building wall of claim 13 and an existing wall against which an end of one of said panels abuts, and a trim secured to the metal panelling includes an end wall sealed to said existing wall from top to bottom of said panel end.

16. The building wall of claim 13 and an existing wall having vertical channels and ridges in its outer surface and against which an end of one of said panels abuts, the sub-girts and metal panelling of said one panel extending beyond the proximate end stud and covering the end of said existing wall, and a U-shaped corner trim the outer wall of which is anchored to said metal panelling and the inner wall of which is entrant of a channel and in frictional engagement with a wall thereof.

17. The building wall of claim 13 and an existing wall formed of like panels against the end one of which an end panel of said building wall abuts, and the finish wall terminates short of the end stud, the sub-girts and metal panelling of the second named end panel extending beyond the end stud thereof to cover the end stud of the first named panel, and a corner trim joined to the exposed ends of the metal panelling of both of said end panels.

* * * * *